United States Patent [19]

Thomas

[11] 4,259,841

[45] Apr. 7, 1981

[54] STEAM ENGINE

[75] Inventor: John C. Thomas, Sarasota, Fla.

[73] Assignee: Universal Research and Development Corp., Tallevast, Fla.

[21] Appl. No.: 39,195

[22] Filed: May 15, 1979

[51] Int. Cl.[3] ..... F01K 11/00

[52] U.S. Cl. ..... 60/669; 60/670; 91/180; 91/324

[58] Field of Search ..... 60/648, 645, 670, 669; 91/180, 324, 352, 467, 470; 74/603, 40, 44

[56] References Cited

U.S. PATENT DOCUMENTS

| | | | |
|---|---|---|---|
| 326,303 | 9/1885 | Long | 91/177 |
| 587,361 | 8/1897 | Dorau | 91/324 |
| 622,577 | 4/1899 | West | 91/180 |
| 1,169,772 | 2/1916 | Chapman | 74/44 |
| 1,330,827 | 2/1920 | Williams et al. | 60/669 |
| 3,074,229 | 1/1963 | Baas | 60/525 |
| 3,165,062 | 1/1965 | Clark | 74/40 |
| 3,319,416 | 5/1967 | Renshaw | 60/525 |
| 3,364,675 | 1/1968 | Dorer | 60/522 |
| 3,717,993 | 2/1973 | Potter | 60/517 |
| 3,890,785 | 6/1975 | Torsten | 60/525 |
| 4,020,635 | 5/1977 | Joynes | 60/517 |

*Primary Examiner*—Allen M. Ostrager
*Assistant Examiner*—Stephen F. Husar
*Attorney, Agent, or Firm*—Benjamin P. Reese, II

[57] ABSTRACT

An improved double-acting, nonexpansion, noncondensing, piston steam engine. A coiled tube flash boiler enclosed in an insulated fire chamber is located above and contiguous with the cylinder head of the steam engine. The base of the fire chamber has a cylindrical opening to enable the heat from the flames in the fire chamber to be transferred directly to the top cylinder head for enhanced heat transfer to the cylinder. Two parallel crank shafts, each having a spur gear fixed thereon which meshes with the spur gear fixed on the other, are mounted on pillow block support bearings. A "T" linkage interconnects the crank shafts and the piston of the steam engine. Two rotary valves are provided to control the flow of high temperature steam and spent steam to and from the cylinder.

4 Claims, 4 Drawing Figures

STEAM ENGINE

BACKGROUND OF INVENTION

This invention relates to an improved double-acting, nonexpansion, noncondensing, piston steam engine.

The first commercially successful steam engine was patented by Thomas Savery in 1698. Savery's engine and its improved versions were used to pump water out of flooded underground mines in all parts of the world until the late eighteenth century. In all of these engines, steam acted either by its momentum alone or by exerting pressure directly on the surface of water.

The important idea of using steam to act against a piston in a cylinder appears to have originated with Denis Papin. About 1690, he constructed a model of a steam engine comprised of a vertical cylinder with a piston. While Papin neglected his own idea to develop Savery's engine, Thomas Newcomen proceeded with development of Papin's idea and patented the first steam engine really worthy of the designation in 1712. Newcomen's engine was a single-acting, condensing, vertical piston steam engine known as an "atmospheric" engine because it used steam at atmospheric pressure.

Beginning in the 1760's James Watt introduced a scientific approach to the development of the steam engine. In 1769, Watt patented an improved Newcomen engine. Watt patented a double-acting steam engine in 1782. In that engine, the steam pushed alternatively on both sides of the piston thereby providing a working force during each stroke and doubling the output of a given size of engine. During this era, Watt and his associates were responsible for other inventions which were directly applicable to the steam engine, including a crank and connecting rod for a steam engine, a sun-and-planet gear, a throttle valve, a governor for regulating speed, a counter for recording the number of pistion strokes, and an indicator for ascertaining the work done by steam. These contributions to the development of the steam engine played a large role in ushering in the Industrial Revolution.

The steam engine dominated the Industrial Revolution and made available a practical source of power for both stationary and mobile applications. During its zenith in the late nineteenth century and early twentieth century, the steam engine supplied most of the power needs of the world. With the introduction of the steam turbine as a prime mover for electric generating stations and the internal combustion engine as a prime mover for mobile power applications, the role of the steam engine as a power source was diminished. Accordingly, no serious developmental activities relating to the steam engine have taken place in the twentieth century prior to various changed socio-economic circumstances in the mid-1970's which have renewed interest in the steam engine.

Since the mid-1970's, the cost of energy generated by burning the world's primary fossil fuels, i.e. coal, oil and natural gas, has increased substantially. Furthermore, because of various social and economic considerations, nuclear fuels have not made as significant a contribution toward meeting the world's total energy requirements as was earlier anticipated. And, the technology necessary for solar energy to make a significant contribution toward meeting these requirements has not been available to date. For these and other reasons, the use of alternate fossil fuels to supply a portion of the world's total energy requirements has become substantially more attractive to energy use planners than was earlier the case. Various alternate fossil fuels, such as wood by-products and waste from the lumber, furniture, plywood and pulp industries, vegetable by-products and waste from the various farming and food products industries, animal by-products and waste from the various animal husbandry and food products industries, treated solid waste from municipal waste treatment facilities, and selected portions of the solid material from municipal garbage disposal operations, are suitable for generation of energy. However, since such fuels have a substantially lower energy content than is the case with the primary fossil fuels, it is generally believed that the alternate fossil fuels cannot be economically used if they must be transported to a large energy generating facility. Accordingly, it is desirable to have small but efficient means for burning such fuels and converting the resulting heat energy to mechanical energy at or near the locations where such fuels are available as by-product or waste materials.

Most of the alternate fossil fuels are not suitable for burning in the internal combustion engine. If such fuels are to be used, they must be burned to heat water for generation of steam. The steam can be used to produce mechanical work for turning a conventional electrical generator. It is well known by those skilled in the art that a small steam engine is more efficient for this purpose than a small steam turbine. And, of course, the aforementioned transportation economics for the alternate fossil fuels dictates the use of smaller-sized equipment.

If the steam engine is to be used as a component of a modern power generation system, major improvements are necessary to reduce thermal and mechanical losses, to improve balance and increase the output rotational speed, and to improve operational reliability. These improvements are needed whether the power generation system is designed for use of alternate fossil fuels or primary fossil fuels. In particular, the steam engine must be capable of continued reliable operation at rotational speeds required for driving modern electrical alternators and generators with minimal thermal and mechanical energy losses.

SUMMARY OF INVENTION

The present invention provides an improved double-acting, nonexpansion, noncondensing, piston steam engine.

The nonexpansion cycle is used for the steam engine of the present invention because the net work per cycle for such an engine is greater than the net work per cycle for an engine having a complete expansion cycle. Thus, if a nonexpansion engine and a complete expansion engine are running at the same speed, the total output of the engine having a nonexpansion cycle is greater than the total output of the engine having a complete expansion cycle. Furthermore, an engine having a nonexpansion cycle is capable of a higher operating speed than is possible with an engine having a complete expansion cycle. Of course, an engine having a nonexpansion cycle does not use the stored heat energy of the steam. However, a source of process steam is needed for many of the power generation systems proposed for use of alternate fuels, and the relatively high heat content steam discharged from the cylinder of the steam engine of the present invention is suitable for process purposes. Furthermore, if relatively high heat content steam is discharged, the metallic surfaces inside the cylinder will be maintained at a relatively high temperature. This substantially reduces energy losses caused by cylinder condensation upon admission of high temperature steam to the cylinder.

The present invention combines the steam generator and the steam engine in a single structure. A coiled tube flash boiler enclosed in an insulated fire chamber is located above and contiguous with the cylinder head of the steam engine. Thus, heat transferred through the base of the fire chamber to the top cylinder head assists in maintaining a relatively high temperature in the cylinder, and thereby, further reduces thermal losses caused by cylinder condensation upon admission of high temperature steam. A cylindrical opening is provided in the base of the fire chamber to enable the heat from the flames in the fire chamber to be transferred directly to the top cylinder head for enhanced heat transfer through the base. And, of course, placement of the steam generator in this location reduces the distance which the high temperature steam must travel through steam lines, and thereby, reduces the inherent decrease in steam temperature between the steam generator and the cylinder of the steam engine. This results in further substantial improvements in the thermal efficiency of the steam engine of the present invention.

The steam engine of the present invention uses two parallel crank shafts mounted on pillow block support bearings. Each of the crank shafts has a spur gear fixed thereon which meshes with the spur gear fixed on the other crank shaft. Each crank shaft has a throw on one end which is connected to a conventional "T" linkage bar by a connecting rod. The "T" linkage bar is rigidly connected to a rigid piston driving rod. As the crank shafts turn in opposite directions, the meshed spur gears maintain perfectly balanced rotation without the necessity of a restraining flywheel on either of the crank shafts. This combination of structural elements enables the steam engine of the present invention to operate at higher rotational speeds than is possible with known steam engines. In particular, the steam engine is capable of continuous reliable operation at the rotational speeds required for driving modern electrical alternators and generators.

Two rotary valves are included as elements of the steam engine of the present invention. These valves are driven by a conventional chain and sprocket mechanism interconnected with one of the crank shafts. It will be readily apparent to those skilled in the art that this structural combination maintains perfect timing for the valves at all times during operation of the steam engine. The inherent loss of work during valve operation is substantially less with the steam engine of the present invention than is the case with steam engines using sliding valves and other known steam engine valves. Also, the rotary valves are significantly more reliable than sliding valves and other known steam engine valves.

These and many other advantages and features of the present invention will be apparent from the following description of drawings, description of the preferred embodiment, and the appended claims.

DESCRIPTION OF DRAWINGS

FIG. 2 is an exploded perspective view of a rotary valve for the steam engine of the present invention.

DESCRIPTION OF THE PREFERRED EMBODIMENT

The preferred embodiment of the steam engine of the present invention is illustrated in FIGS. 1–4. A single cylinder engine is illustrated. Nevertheless, with appropriate modifications, the structure which is disclosed can be used for a multiple cylinder engine.

Figure 1:
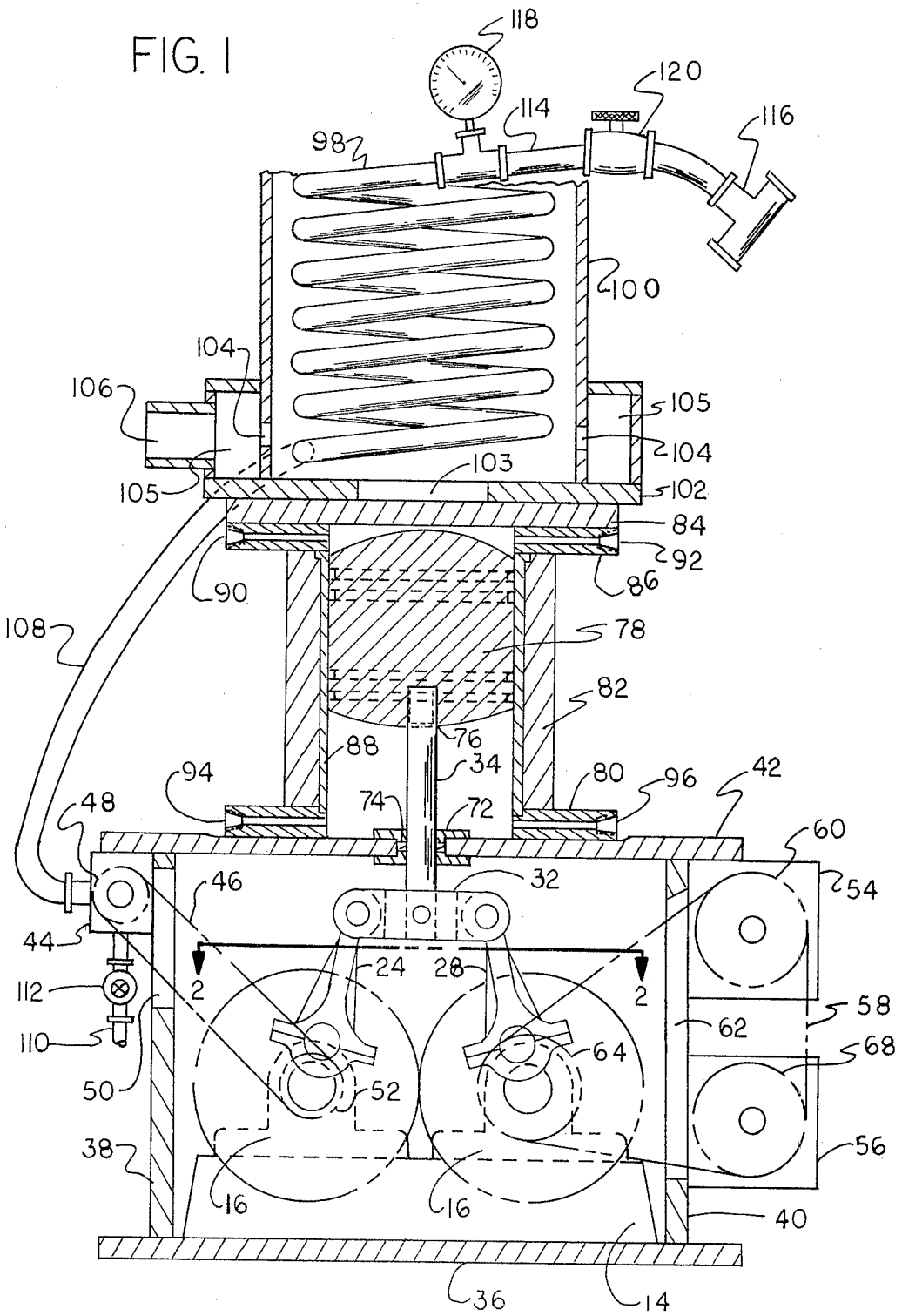
FIG. 1 is an elevational view, in section, of the steam engine of the present invention.
Figure 2:
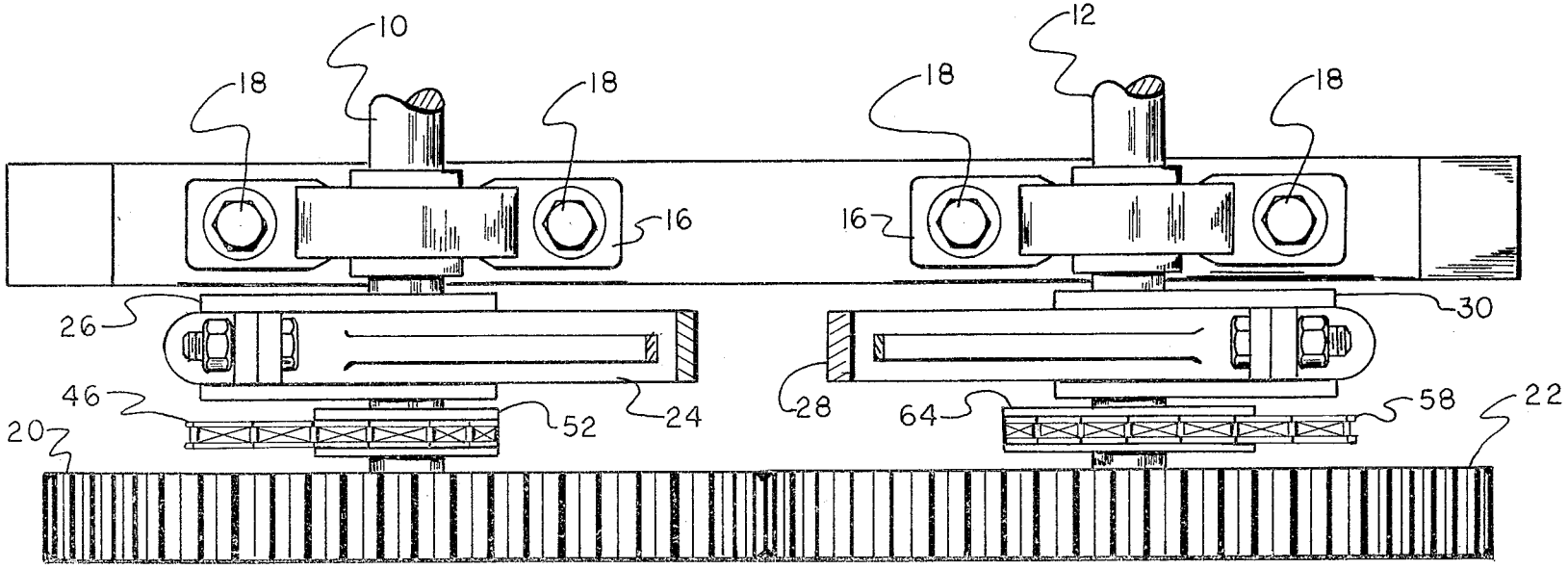
FIG. 2 is a sectional view through lines 2—2 in FIG. 1, but illustrating an alternate arrangement whereby the relative positions of the spur gears and throws on the crank shafts are transposed.
Figure 3:
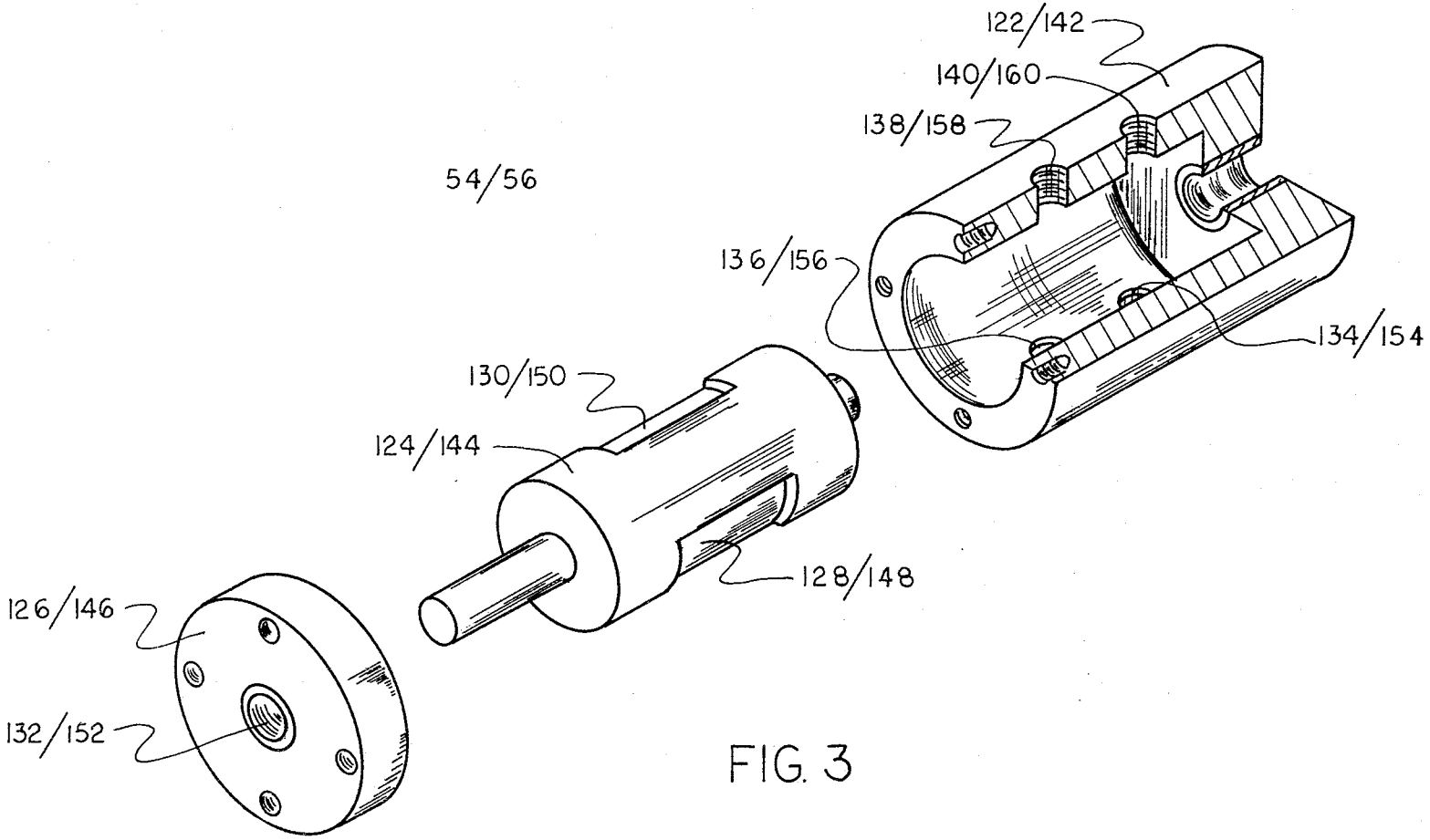

As illustrated in FIGS. 1 and 2, crank shaft 10 and crank shaft 12 are rotatably mounted on support base 14. At least two each of pillow block bearing 16 are used to mount each crank shaft on support base 14 with the longitudinal axis of each crank shaft aligned in a horizontal direction parallel to the longitudinal axis of the other crank shaft. Conventional means, such as a plurality of shoulder screw 18 for cooperation with threaded screw holes in support base 14, are used to attach each pillow block bearing to support base 14.

Spur gear 20 fixedly attached to crank shaft 10 rotatably meshes with spur gear 22 fixedly attached to crank shaft 12. One end of connecting rod 24 is pivotedly attached to throw 26 on crank shaft 10, and one end of connecting rod 28 is pivotedly attached to throw 30 on crank shaft 12. The opposite end of connecting arm 24 and the opposite end of connecting arm 28 are pivotedly attached to opposite ends of "T" linkage bar 32. Conventional means, such as bolts, lock nuts and cotter pins, are used to pivotedly attach each end of each connecting rod at the appropriate locations. Rigid piston driving rod 34 is rigidly attached to the center of "T" linkage bar 32 by conventional means.

The above described combination of elements is enclosed in a support housing comprised of support housing base 36, vertical support member 38, vertical support member 40, horizontal support member 42 and two vertical support members not shown in FIG. 1, all of which are combined in a rectangular structure. Feed water pump 44 is attached to the exterior surface of vertical support member 38 by conventional means, such as shoulder screws for cooperation with threaded screw holes in vertical support member 38. Chain 46 engages sprocket 48 fixedly attached to the drive shaft of feed water pump 44, passes through rectangular opening 50 in vertical support member 38, and engages sprocket 52 fixedly attached to crank shaft 10. Rotary valve 54 and rotary valve 56 are each attached to the exterior surface of vertical support member 40 by conventional means, such as shoulder screws for cooperation with threaded screw holes in vertical support member 40. Chain 58 engages sprocket 60 fixedly attached to the drive shaft of rotary valve 54 and sprocket 68 fixedly attached to the drive shaft of rotary valve 56, passes through rectangular opening 62 in vertical support member 40, and engages sprocket 64 fixedly attached to crank shaft 12. It will be readily apparent to those skilled in the art that the two rotary valves could be combined in a single rotary valve if desired.

Horizontal support member 42 functions both as the top element of the aforementioned support housing and as the bottom head for the cylinder of the steam engine. Piston driving rod 34 passes through the cylindrical opening in conventional bushing 72 removably fitted in cylindrical opening 74 of horizontal support member 42. The upper end of piston driving rod 34 cooperates with cylindrical hole 76 in the bottom face of piston 78 and is rigidly fastened thereto by conventional means. Bottom flange 80 of cylinder housing 82 is attached to the upper surface of horizontal support member 42 by conventional means, such as shoulder screws for cooperation with threaded screw holes in horizontal support member 42. Top cylinder head 84 is attached to the upper surface of top flange 86 of cylinder housing 82 by conventional means, such as shoulder screws for cooperation with threaded screw holes in top flange 86. Cylinder liner 88 is removably fitted to the interior surface of cylinder housing 82. It can be readily seen by those skilled in the art that cylinder housing 82 can be fabricated by various conventional means, including either bolting or welding a flange plate to each end of a cylindrical housing or casting the housing as a single component. Top steam port 90 and top steam port 92 are provided through top flange 86 of cylinder housing 82. Bottom steam port 94 and bottom steam port 96 are provided through bottom flange 80 of cylinder housing 82.

The steam generator, shown symbolically in FIG. 1, is a coiled tube blash boiler 98 enclosed in an insulated fire chamber 100. Base 102 of fire chamber 100 is attached to the upper surface of top cylinder head 84 by conventional means, such as shoulder screws for cooperation with threaded screw holes in cylinder head 84. A conventional burner for fuels, not shown in FIG. 1, provides the heat input necessary to flash the water in coiled tube flash boiler 98 to steam. Base 102 of fire chamber 100 has a cylindrical opening 103 which enables the heat from the flames in the fire chamber to be transferred directly to top cylinder head 84 for enhanced heat transfer through base 102 and into the cylinder. Fire chamber 100 has a plurality of holes 104 through its vertical wall for discharge of exhaust gases into exhaust plentum 105 having an exhaust port 106 for discharge of exhaust gases from the steam generator.

Feed water line 108 connects the outlet of conventional feed water pump 44 to the inlet of coiled tube flash boiler 98. Feed water line 110 connects the inlet of conventional feed water pump 48 to a conventional water supply. Feed water shutoff valve 112, a conventional cock valve, is provided in feed water tube 110 to enable operator control of the flow of water to the inlet of feed water pump 44. Main steam line 114 connects the outlet of coiled tube flash boiler 98 to "T" connector 116. Steam pressure gauge 118 is provided in main steam line 114 to sense steam pressure and provide steam pressure information necessary for operational control of the steam engine. Steam shutoff valve 120, a conventional cock valve, is provided in main steam line 114 to provide a means for preventing flow of steam to the rotary valves to enable steam pressure build-up for start up of the steam engine and to provide a means for controlling steam pressure and flow during operation of the steam engine.

Rotary valve 54 is comprised of cylindrical housing 122, cylindrical shaft 124 and cylindrical end cover 126. Steam cavity 128 and steam cavity 130 are provided in cylindrical shaft 124. Cylindrical shaft 124 is rotatably mounted in cylindrical housing 122 and end cover 126 is attached to cylindrical housing 122 by conventional means, such as shoulder screws, for cooperation with threaded screw holes in one end of cylindrical housing 122, with a portion of cylindrical shaft 124 protruding through cylindrical opening 132 in end cover 126 for attachment to sprocket 60. Steam admission port 134, steam admission port 136, steam exhaust port 138 and steam exhaust port 140 are provided through cylindrical housing 122.

Rotary valve 56 is comprised of cylindrical housing 142, cylindrical shaft 144 and cylindrical end cover 146. Steam cavity 148 and steam cavity 150 are provided in cylindrical shaft 144. Cylindrical shaft 144 is rotatably mounted in cylindrical housing 142 and end cover 146 is attached to cylindrical housing 142 by conventional means, such as shoulder screws, for cooperation with threaded screw holes in one end of cylindrical housing 142, with a portion of cylindrical shaft 144 protruding through cylindrical opening 152 in end cover 146 for attachment of sprocket 68. Steam admission port 154, steam admission port 156, steam exhaust port 158 and steam exhaust port 160 are provided through cylindrical housing 152.

Figure 4:
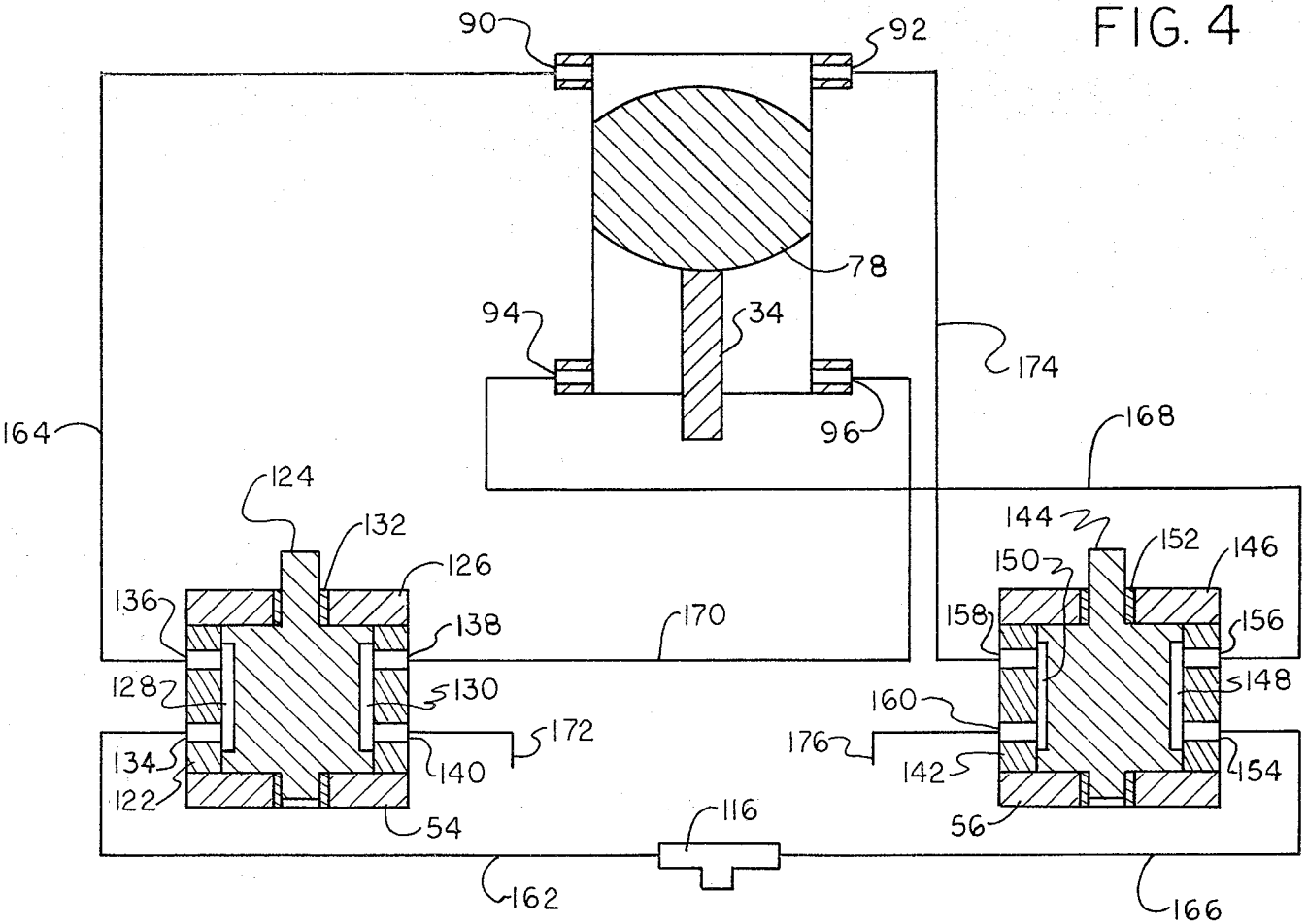
FIG. 4 is a schematic view illustrating the steam line interconnections for the steam engine of the present invention.

The steam admission and discharge lines for the steam engine of the present invention are illustrated in FIG. 4. Steam admission line 162 connects "T" connector 116 and steam admission port 134 in rotary valve 54. Steam admission line 164 connects steam admission port 136 in rotary valve 54 and top steam port 90 of the cylinder. Steam admission line 166 connects "T" connector 116 and steam admission port 154 of rotary valve 56. Steam admission line 168 connects steam admission port 156 of rotary valve 56 and bottom steam port 94 of the cylinder. Steam exhaust line 170 connects bottom port 96 of the cylinder and steam exhaust port 138 of rotary valve 54. Steam exhaust line 172 connects steam exhaust port 140 of rotary valve 54 to an appropriate means for either using discharged steam for process purposes or venting said steam to the surrounding atmosphere. Steam exhaust line 174 connects top port 92 of the cylinder and steam exhaust port 158 of rotary valve 56. Steam exhaust line 176 connects steam exhaust port 160 of rotary valve 56 to an appropriate means for either using discharged steam for process purposes or venting said steam to the surrounding atmosphere. Conventional steam line fittings are used for each of the aforementioned connections. Having described the structure of the steam engine of the present invention, its operation will now be described.

Prior to start up and subsequent operation of the steam engine, the steam generator is fired in the start up mode to allow steam pressure to build up to the desired operating level. First, steam shutoff valve 120 is closed to prevent steam flow to the steam engine. Next, feed water shutoff valve 112 is opened and coiled tube flash boiler 98 is primed with water. Feed water shutoff valve 112 is closed and the burner is fired to ignite the fuel, and thereby, provide heat to flash the water in coiled tube flash boiler 98 to steam. The operator observes steam pressure gauge 118 to monitor the build up of steam pressure in coiled tube flash boiler 98. When the steam pressure reaches the desired operating level, steam shutoff valve 120 is opened and feed water shutoff valve 112 is opened. When both of these valves are opened, a continuous flow of water enters the steam generator and a continuous flow of high temperature steam exits the steam generator.

High temperature steam from the steam generator travels through main steam line 114 to "T" connector 116. At "T" connector 116, one-half of the high temperature steam travels through steam admission line 162 to steam admission port 134 in rotary valve 54 and one-half of the high temperature steam travels through steam admission line 166 to steam admission port 154 in rotary valve 56. With cylinder 78 in its top dead-center position, steam cavity 128 in cylindrical shaft 124 of rotary valve 54 is aligned with steam admission port 134 and steam admission port 136 through cylindrical housing 122. Thus, high temperature steam from steam admission line 162 enters rotary valve 54 through steam admission port 134 and exits rotary valve 54 through steam admission port 136 where it enters steam admission line 164 and travels to top steam port 90 in cylinder housing 82. High temperature steam enters the cylinder through top steam port 90, expands slightly as it overcomes the momentum of piston 78, and begins to force piston 78 downward.

The continued flow of high temperature steam into the cylinder through top steam port 90 forces piston 78 downward to its bottom dead-center position. As piston 78 moves downward, piston driving rod 34, acting through mechanical means described hereinabove, rotates crank shaft 10 and crank shaft 12. Either crank shaft 10 or crank shaft 12 rotates the input power shaft of a conventional machine, such as an electrical generator. As crank shaft 10 rotates, mechanical means described hereinabove drive feed water pump 44. As crank shaft 12 rotates, mechanical means described hereinabove drive rotary valve 54 and rotary valve 56.

As piston 78 moves downward, cylindrical shaft 124 of rotary valve 54 rotates with steam cavity 128 aligned with steam admission port 134 and steam admission port 136 through cylindrical housing 122 for approximately 75° of rotation. During this time period, steam cavity 130 is aligned with steam exhaust port 138 and steam exhaust port 140. Thus, as piston 78 moves downward, spent steam is discharged from the bottom of the cylinder through bottom steam port 96, travels through steam exhaust line 170 to steam exhaust port 138 through cylindrical housing 122 of rotary valve 54. Spent steam enters steam cavity 130 through steam exhaust port 138 and exits steam cavity 130 through steam exhaust port 140. Spent steam existing rotary valve 54 in this manner enters steam exhaust line 172 and travels to an appropriate means for either using the discharged steam for process purposes or venting said steam to the surrounding atmosphere.

With cylinder 78 in its bottom dead-center position, steam cavity 148 in cylindrical shaft 144 of rotary valve 56 is aligned with steam admission port 154 and steam admission port 156 through cylindrical housing 142. Thus, high temperature steam from steam admission line 166 enters rotary valve 56 through steam admission port 154 and exits rotary valve 56 through steam admission port 156 where it enters steam admission line 168 and travels to bottom steam port 94 in cylinder housing 82. High temperature steam enters the cylinder through bottom steam port 94, expands slightly as it overcomes the momentum of piston 78, and begins to force piston 78 upward.

The continued flow of high temperature steam into the cylinder through bottom steam port 94 forces piston 78 upward to its top dead-center position. As piston 78 moves upward, piston driving rod 34, acting through mechanical means described hereinabove, rotates crank shaft 10 and crank shaft 12. This continues the rotation of the input power shaft of a conventional machine and continues to drive feed water pump 44, rotary valve 54 and rotary valve 56 in the manner described hereinabove.

As piston 78 moves upward, cylindrical shaft 144 of rotary valve 56 rotates with steam cavity 148 aligned with steam admission port 154 and steam admission port 156 through cylindrical housing 142 for approximately 75° of rotation. During this time period, steam cavity 150 is aligned with steam exhaust port 158 and steam exhaust port 160. Thus, as piston 78 moves upward, spent steam is discharged from the top of the cylinder through top steam port 92, travels through steam exhaust line 174 to steam exhaust port 158 through cylindrical housing 142 of rotary valve 56. Spent steam enters steam cavity 150 through steam exhaust port 158 and exits steam cavity 150 through steam exhaust port 160. Spent steam exiting rotary valve 56 in this manner enters steam exhaust line 176 and travels to an appropriate means for either using the discharged steam for process purposes or venting said steam to the surrounding atmosphere.

The operational cycle described hereinabove is repeated for continuous operation of the steam engine of the present invention.

While the present invention has been disclosed in connection with the preferred embodiment thereof, it should be understood that there may be other embodiments which fall within the spirit and scope of the invention as defined by the following claims:

I claim:

1. A steam engine, comprising:

(a) a cylinder housing having a top steam port therethrough for admission of high temperature steam, a bottom steam port therethrough for admission of high temperature steam, a top steam port therethrough for discharge of spent steam and a bottom steam port therethrough for discharge of spent steam;

(b) a top cylinder head attached to said cylinder housing;

(c) a support housing comprised of a support housing base, four vertical support members and a horizontal support member which functions both as the top element of said support housing and as a bottom cylinder head, said horizontal support member having a cylindrical opening therethrough to accommodate vertical movement of a piston driving rod;

(d) a piston, having a top face and a bottom face, movably located in the cylinder formed by the structural combination of said cylinder housing, said top cylinder head and said horizontal support member of said support housing;

(e) a rigid piston driving rod movably located in said cylindrical opening in said horizontal support member with one end rigidly attached to the bottom face of said piston and the other end rigidly attached to a "T" linkage bar, and having a longitudinal dimension which locates said top face of said piston just below said top steam ports when said piston is in its top dead-center position and which locates said bottom face of said piston just below said bottom steam ports when said piston is in its bottom dead-center position;

(f) a pair of crank shafts, each rotatably mounted on pillow block bearings fixedly attached to a support base with its longitudinal axis aligned in a horizontal direction parallel to the longitudinal axis of the other and each having a throw on the same end;

(g) a pair of connecting rods, each having one end pivotedly attached to one of said throws and the opposite end pivotedly attached to one end of said "T" linkage bar;

(h) a pair of rotatably meshed spur gears, each fixedly attached to one of said crank shafts;

(i) a coiled tube flash boiler enclosed in an insulated fire chamber located above and contiguous with said cylinder head, said fire chamber having a base with a cylindrical opening therein to enable the flames in said fire chamber to impinge directly on said top cylinder head for enhanced heat transfer through said base;

(j) a pair of rotary valves, each comprised of a cylindrical housing having a pair of steam admission ports and a pair of steam exhaust ports, a cylindrical shaft having a pair of opposed steam cavities and a cylindrical end cover;

(k) a chain and sprocket mechanism interconnecting said rotary valves and one of said crank shafts for rotation of said rotary valves during operation of the steam engine;

(l) a steam line connecting said coiled tube flash boiler and one of said steam admission ports through said cylindrical housing of one of said rotary valves, a steam line connecting the other of said steam admission ports and said top steam port for admission of high temperature steam through said cylinder housing, a steam line connecting said bottom steam port for discharge of spent steam through said cylinder housing and one of said steam exhaust ports through said cylindrical housing of said rotary valve, and a steam line connecting said other steam exhaust port and a means for using said spent steam for process purposes or venting said spent steam to the atmosphere; and (m) a steam line connecting said coiled tube flash boiler and one of said steam admission ports through said cylindrical housing of the other of said rotary valves, a steam line connecting the other of said steam admission ports and said bottom steam port for the admission of high temperature steam through said cylinder housing, a steam line connecting said top steam port for discharge of spent steam through said cylinder housing and one of said steam exhaust ports through said cylindrical housing of said rotary valve and a steam line connecting said other steam exhaust port and a means for using said spent steam for process purposes or venting said spent steam to the atmosphere.

2. A steam engine, comprising:

(a) a cylinder housing having a top steam port therethrough for admission of high temperature steam, a bottom steam port therethrough for admission of high temperature steam, a top steam port therethrough for discharge of spent steam and a bottom steam port therethrough for discharge of spent steam;

(b) a top cylinder head attached to said cylinder housing;

(c) a bottom cylinder head attached to said cylinder housing and having a cylindrical opening therethrough to accommodate vertical movement of a piston driving rod;

(d) a piston, having a top face and a bottom face, movably located in the cylinder formed by the structural combination of said cylinder housing, said top cylinder head and said bottom cylinder head;

(e) a rigid piston driving rod movably located in said cylindrical opening in said bottom cylinder head with one end rigidly attached to the bottom face of said piston and the other end rigidly attached to a "T" linkage bar, and having a longitudinal dimension which locates said top face of said piston just below said top steam ports when said piston is in its top dead-center position and which locates said bottom face of said piston just above said bottom steam ports when said piston is in its bottom dead-center position;

(f) a pair of crank shafts, each rotatably mounted on pillow block bearings fixedly attached to a support base with its longitudinal axis aligned in a horizontal direction parallel to the longitudinal axis of the other and each having a throw on the same end;

(g) a pair of connecting rods, each having one end pivotedly attached to one of said throws and the opposite end pivotedly attached to one end of said "T" linkage bar;

(h) a pair of rotatably meshed spur gears, each fixedly attached to one of said crank shafts;

(i) a means for supporting said cylinder housing, said top cylinder head and said bottom cylinder head above said crank shafts, said connecting rods and said "T" linkage bar;

(j) a source of high temperature steam;

(k) steam lines connecting said source of high temperature steam and said top steam port for admission of high temperature steam;

(l) steam lines connecting said bottom steam port for discharge of spent steam and a means for using said spent steam for process purposes or venting said spent steam to the atmosphere;

(m) a rotary valve, comprised of a cylindrical housing having a pair of steam admission ports and a pair of steam exhaust ports, a cylindrical shaft having a pair of opposed cavities and a cylindrical end cover, for continuously and automatically controlling the flow of said high temperature steam to said top steam port for admission of high temperature steam during the desired time periods for admission of high temperature steam above said top face of said piston during operation of the steam engine and for continuously and automatically controlling the flow of spent steam from said bottom steam port for discharge of spent steam simultaneous with the flow of high temperature steam to said top steam port for admission of high temperature steam;

(n) steam lines connecting said source of high temperature steam and said bottom steam port for admission of high temperature steam;

(o) valve means for continuously and automatically controlling the flow of said high temperature steam to said bottom steam port for admission of high temperature steam during the desired time periods for admission of high temperature steam below said bottom face of said piston during operation of the steam engine;

(p) steam lines connecting said top steam port for discharge of spent steam and a means for using said steam for process purposes or venting said spent steam to the atmosphere; and (q) valve means for continuously and automatically controlling the flow of spent steam from said top steam port for discharge of spent steam simultaneous with the flow of high temperature steam to said bottom steam port for the admission of high temperature steam.

3. A steam engine, comprising:

(a) a cylinder housing having a top steam port therethrough for admission of high temperature steam, a bottom steam port therethrough for admission of high temperature steam, a top steam port therethrough for discharge of spent steam and a bottom steam port therethrough for discharge of spent steam;

(b) a top cylinder head attached to said cylinder housing;

(c) a bottom cylinder head attached to said cylinder housing and having a cylindrical opening therethrough to accommodate vertical movement of a piston driving rod;

(d) a piston, having a top face and a bottom face, movably located in the cylinder formed by the structural combination of said cylinder housing, said top cylinder head and said bottom cylinder head;

(e) a rigid piston driving rod movably located in said cylindrical opening in said bottom cylinder head with one end rigidly attached to the bottom face of said piston and the other end rigidly attached to a "T" linkage bar, and having a longitudinal dimension which locates said top face of said piston just below said top steam ports when said piston is in its top dead-center position and which locates said bottom face of said piston just above said bottom steam ports when said piston is in its bottom dead-center position;

(f) a pair of crank shafts, each rotatably mounted on pillow lock bearings fixedly attached to a support base with its longitudinal axis aligned in a horizontal direction parallel to the longitudinal axis of the other and each having a throw on the same end;

(g) a pair of connecting rods, each having one end pivotedly attached to one of said throws and the opposite end pivotedly attached to one end of said "T" linkage bar;

(h) a pair of rotatably meshed spur gears, each fixedly attached to one of said crank shafts;

(i) a means for supporting said cylinder housing, said top cylinder head and said bottom cylinder head above said crank shafts, said connecting rods and said "T" linkage bar;

(j) a source of high temperature steam;

(k) steam lines connecting said source of high temperature steam and said top steam port for admission of high temperature steam;

(l) valve means for continuously and automatically controlling the flow of said high temperature steam to said top steam port for admission of high temperature steam during the desired time periods for admission of high temperature steam above said top face of said piston during operation of the steam engine;

(m) steam lines connecting said bottom steam port for discharge of spent steam and a means for using said spent steam for process purposes or venting said spent steam to the atmosphere;

(n) valve means for continuously and automatically controlling the flow of spent steam from said bottom steam port for discharge of spent steam simultaneous with the flow of high temperature steam to said top steam port for the admission of high temperature steam;

(o) steam lines connecting said source of high temperature steam and said bottom steam port for admission of high temperature steam;

(p) steam lines connecting said top steam port for discharge of spent steam and a means for using said steam for process purposes or venting said spent steam to the atmosphere; and (q) a rotary valve, comprised of a cylindrical housing having a pair of steam admission ports and a pair of steam exhaust ports, a cylindrical shaft having a pair of opposed steam cavities and a cylindrical end cover, for continuously and automatically controlling the flow of said high temperature steam to said bottom steam port for admission of high temperature steam during the desired time periods for admission of high temperature steam below said bottom surface of said piston during operation of the steam engine and for continuously and automatically controlling the flow of spent steam from said top steam port for discharge of spent steam simultaneous with the flow of high temperature steam to said bottom steam port for the admission of high temperature steam.

4. A steam engine as recited in claim 2 or claim 3, wherein said rotary valve is attached to the exterior surface of one of said vertical support members of said support housing and rotated by a chain and sprocket mechanism interconnecting said rotary valve and one of said crank shafts.

* * * * *